US010582734B1

(12) United States Patent
Price

(10) Patent No.: US 10,582,734 B1
(45) Date of Patent: Mar. 10, 2020

(54) MAGNETIC ZIPPER

(71) Applicant: Angela Price, Williams, AZ (US)

(72) Inventor: Angela Price, Williams, AZ (US)

( * ) Notice: Subject to any disclaimer, the term of this patent is extended or adjusted under 35 U.S.C. 154(b) by 0 days.

(21) Appl. No.: 15/944,538

(22) Filed: Apr. 3, 2018

Related U.S. Application Data

(63) Continuation-in-part of application No. 14/074,568, filed on Nov. 7, 2013, now abandoned.

(60) Provisional application No. 61/723,869, filed on Nov. 8, 2012.

(51) Int. Cl.

| | |
|---|---|
| ***A44B 19/04*** | (2006.01) |
| ***A41F 1/00*** | (2006.01) |
| ***A44B 19/24*** | (2006.01) |
| ***A44B 19/08*** | (2006.01) |

(52) U.S. Cl.
CPC ..... *A41F 1/002* (2013.01); *A44B 19/08* (2013.01); *A44B 19/24* (2013.01); *A44D 2203/00* (2013.01)

(58) Field of Classification Search
CPC ..... A44B 19/04; A44B 19/10; A44B 19/14; A44B 19/16; A44B 19/02; A44B 19/06; A44B 19/08; A44B 19/24; B65B 61/188; A41F 1/002; A44D 2203/00; Y10T 24/2539; Y10T 24/2545; Y10T 24/2593
See application file for complete search history.

(56) References Cited

U.S. PATENT DOCUMENTS

| | | | | |
|---|---|---|---|---|
| 2,389,298 | A * | 11/1945 | Ellis | A41F 1/002 101/389.1 |
| 3,161,932 | A * | 12/1964 | Russell | A41F 1/002 24/303 |
| 4,399,595 | A * | 8/1983 | Yoon | A41F 1/002 24/303 |
| 6,301,754 | B1 * | 10/2001 | Grunberger | A41F 1/002 24/303 |
| 6,681,456 | B1 * | 1/2004 | Dischler | A44B 19/14 24/403 |
| 9,721,712 | B2 * | 8/2017 | Provencher | H01F 7/0263 |
| 2006/0112523 | A1 * | 6/2006 | Deto | A41F 1/002 24/303 |
| 2007/0277353 | A1 * | 12/2007 | Kondo | A41F 1/002 24/403 |
| 2009/0049658 | A1 * | 2/2009 | Takasawa | A44B 19/06 24/401 |
| 2013/0061431 | A1 * | 3/2013 | Naftali | H01F 7/0215 24/303 |

* cited by examiner

*Primary Examiner* — Robert Sandy
*Assistant Examiner* — Rowland Do
(74) *Attorney, Agent, or Firm* — Kenneth L. Tolar

(57) ABSTRACT

A magnetic zipper includes a pair of mating strands each having a plurality of spaced teeth formed on an inner edge thereof with mating notches formed therebetween. Positioned within each of the notches on both strands is a magnet having a given polarity. Attached to each tooth on both strands is a magnet having a polarity opposite that of the given polarity. The size or geometric configuration of the teeth and notches successively vary so that the two strands cannot be inadvertently joined when misaligned. Accordingly, when the teeth on one strand are positioned near or in their designated notches on the other, the zipper strands firmly adhere to close a garment opening. To open the zipper, a garment wearer simply pulls the tenuously-held zipper strands apart.

1 Claim, 1 Drawing Sheet

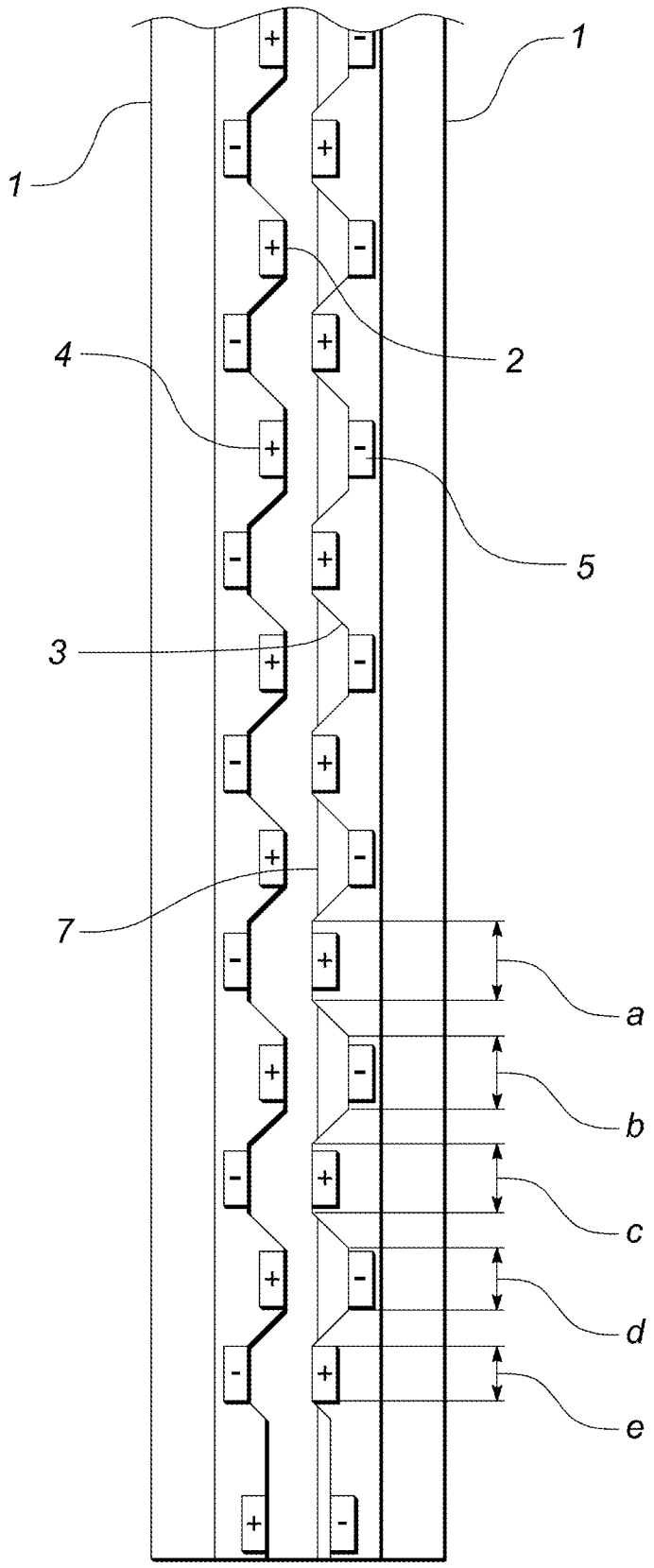
1
1
2
4
5
3
7
a
b
c
d
e

MAGNETIC ZIPPER

CROSS REFERENCE TO RELATED APPLICATIONS

This application is a continuation-in-part of application Ser. No. 14/074,568 filed on Nov. 7, 2013, which claimed the benefit of provisional patent application No. 61/723,869 filed on Nov. 8, 2012, the specifications of which are both incorporated herein by reference.

BACKGROUND OF THE INVENTION

The present invention relates to a magnetic zipper that is more easily manipulated by those with certain physical impairments.

DESCRIPTION OF THE PRIOR ART

A conventional zipper is operated by properly aligning two mating strands and moving a slider to join or separate the strands. However, the strands are tedious to align and the slider often binds or hangs. As a result, those with arthritis, Parkinson's disease or similar debilitating illnesses cannot align the strands or pull the slider, and, therefore, are unable to dress without assistance.

Accordingly, there is currently a need for a garment closure that can be easily manipulated by those with certain physical ailments. A review of the prior art reveals at least one magnetic zipper that purportedly addresses these problems. For example, U.S. patent publication no. 2007/0277353 to Kondo discloses a fastener formed of a pair of strands, each having identical magnets thereon. The identical magnets on one strand are spaced at intervals relative to the identical magnets on the other strand. In order to fasten the two strands, a user must position each magnet on one strand beneath a magnet on the other strand so that the north pole of one is near the south pole of the other. As such, each magnet will only adhere to another magnet if its upper end is positioned immediately adjacent to a lower end of another magnet, or its lower end is positioned near the upper end of another magnet. As a result, the device is far more cumbersome to secure since it requires careful vertical alignment of the individual magnets as described above.

The present invention overcomes the limitations of the prior art by providing a zipper formed of a pair of strands that are releasably joined with integral magnets. Each strand includes spaced teeth on inner edge with mating notches therebetween wherein each tooth on both strands has a magnet with a given polarity, and the notches on both strands each have a magnet therein with a polarity opposite that of the given polarity. Therefore, the zipper can be easily joined by simply positioning the notches on one strand near the teeth on the other. Because the magnets are easily separated with minimal force, those with physical impairments can easily operate the zipper without assistance.

Furthermore, if the teeth and notches were the same shape and/or size, the two strands would readily cling whenever they are near each other regardless of their relative positions; therefore, the two strands could easily be joined in a misaligned position, particularly if the user is inattentive or visually impaired. For example, an uppermost tooth may inadvertently seat within a lower notch on the other strand instead of the designated uppermost notch. If so, the zipper will be improperly fastened and unsightly unless the user repeatedly detaches and rejoins the strands until a correct closure is attained. The present invention also addresses this problem by providing an easily attachable magnetic fastener having one or more series of successive, varying-sized teeth and notches to prevent fastening unless the teeth are properly seated within their designated notches.

SUMMARY OF THE INVENTION

A magnetic zipper includes a pair of mating strands, each having a plurality of spaced teeth formed on an inner edge thereof with notches formed therebetween. Positioned within each of the notches on both strands is a magnet having a given polarity. Embedded in or attached to each tooth on both strands is a magnet having a polarity opposite that of the magnets within the notches. A predetermined number of successive teeth and notches on both strands each have a discrete, varying dimension or configuration so that the first tooth on one strand can only be joined with a first notch on the opposing strand, and so on. Accordingly, when the teeth on one strand are positioned near or in the mating corresponding notches on the other, the zipper strands firmly adhere to close a garment or other opening. However, if the user initially misaligns the teeth on one strand with the notches on the other, the teeth and notches will not mesh, preventing the strands from clinging until the two strands are properly aligned. To open the zipper, a garment wearer simply pulls the tenuously held zipper strands apart.

It is therefore an object of the present invention to provide a zipper that can be easily manipulated by those with certain physical impairments.

It is another object of the present invention to provide a zipper formed of two magnetic strands that automatically adhere to close a garment opening.

It is another object of the present invention to provide a zipper formed of two magnetic strands having successive teeth and notches that each have a discrete size or configuration to prevent the zipper from closing unless the two strands are properly aligned.

Other objects, features, and advantages of the present invention will become readily apparent from the following detailed description of the preferred embodiment when considered with the attached drawings and the appended claims.

BRIEF DESCRIPTION OF THE DRAWINGS

FIG. 1 is a front, plan view of the zipper according to the present invention.

DESCRIPTION OF THE PREFERRED EMBODIMENT

A magnetic zipper includes a pair of mating strands 1, each having a plurality of spaced teeth 2 formed on an inner edge thereof with notches 3 formed therebetween. Positioned within each of the notches on both strands is a magnet 5 having a given polarity. Embedded in or attached to each tooth on both strands is a magnet 4 having a polarity opposite that of the magnets within the notches. One of the strands 5 may also include a lip 7 on a rear edge that is positioned within each notch for preventing the teeth from shifting horizontally while a garment is being worn.

A predetermined number of successive teeth and notches on both strands each have a discrete, varying dimension so that the first tooth on one strand can only be joined with a first notch on the opposing strand, the second tooth on one strand can only be joined with the second notch on the other strand, and so on. FIG. 1 depicts multiple sets of five consecutive varying-sized teeth and notches having discrete dimensions a, b, c, d and e. However, the predetermined number of successively varying teeth can be two or more depending upon the size of the zipper and the type of article being joined. Furthermore, the predetermined number can repeatedly cycle between two or more sets, or the predetermined number may simply continue from one end of the strand to the other depending upon the application.

Accordingly, when the teeth on one strand are positioned near or in the mating corresponding notches on the other, the zipper strands firmly adhere to close a garment or other article opening. However, if the user initially misaligns the teeth on one strand with the notches on the other, the successive varying-sized teeth and notches will prevent the strands from clinging until the two strands are properly aligned. To open the zipper, a garment wearer simply pulls the tenuously held zipper strands apart.

The above-described device is not limited to the exact details of construction and enumeration of parts provided herein. For example, though the device has been primarily depicted and described as being designed for clothing, it can be equally incorporated into bags, luggage or any other item having a zipper closure. Moreover, though the teeth and notches have been depicted and described as successively varying in size, they can also vary in shape, geometry or other configuration as long as a given tooth within a series can only fit within a designated notch within a corresponding series on the other strand. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A magnetic zipper comprising:

a first strand having a plurality of spaced teeth on an inner edge with notches therebetween;

a second strand adjacent to said first strand, said second strand having a plurality of spaced teeth on an inner edge with notches therebetween, wherein a predetermined number of teeth on said first strand successively vary in dimension, and a predetermined number of notches on said second strand successively vary in dimension so that each of the predetermined number of teeth on said first strand only fit within a designated one of said predetermined notches on said second strand to prevent said first strand and said second strand from being joined in a misaligned orientation;

a first magnet positioned within each of the notches on said first strand and said second strand, said first magnet having a predetermined polarity;

a second magnet positioned on each of the teeth on said first strand and said second strand, said second magnet having an opposite polarity than said predetermined polarity whereby when said teeth on said second strand are positioned near the notches on said first strand, said first strand and said second strand firmly join;

a lip within each of said notches on either of said first strand and said second strand that prevents the teeth from shifting horizontally during use.

* * * * *